United States Patent [19]

Ejima

[11] 4,377,203

[45] Mar. 22, 1983

[54] RADIATOR EQUIPPED WITH A CENTRIFUGAL FAN

[75] Inventor: Kikuo Ejima, Isehara, Japan

[73] Assignee: Kabushiki Kaisha Komatsu Seisakusho, Tokyo, Japan

[21] Appl. No.: 264,444

[22] Filed: May 18, 1981

[30] Foreign Application Priority Data

| | | | |
|---|---|---|---|
| May 20, 1980 | [JP] | Japan | 55-68223[U] |
| May 20, 1980 | [JP] | Japan | 55-68224[U] |
| May 21, 1980 | [JP] | Japan | 55-68736[U] |
| May 21, 1980 | [JP] | Japan | 55-68737[U] |
| May 21, 1980 | [JP] | Japan | 55-68738[U] |

[51] Int. Cl.[3] ..... F28D 1/04; F01P 3/18

[52] U.S. Cl. ..... 165/125; 123/41.44; 123/41.49; 165/153

[58] Field of Search ..... 123/41.11, 41.46, 41.49, 123/41.01, 41.02, 41.44, 41.48; 165/125, 149, 153; 236/34, 35

[56] References Cited

U.S. PATENT DOCUMENTS

| | | | |
|---|---|---|---|
| 1,390,899 | 9/1921 | Froelich | 165/125 |
| 3,921,603 | 11/1975 | Bentz et al. | 123/41.33 |
| 4,062,401 | 12/1977 | Rudny et al. | 123/41.49 |

*Primary Examiner*—William A. Cuchlinski, Jr.
*Attorney, Agent, or Firm*—Armstrong, Nikaido, Marmelstein & Kubovcik

[57] ABSTRACT

A centrifugal fan is disposed within a chamber encircled in part by a radiator assembly with the centrifugal fan being effective for creating an air flow outwardly through radiator cores. The radiator assembly comprises a first tank, a second tank and a plurality of tube-like cores interconnecting the first and second tanks.

9 Claims, 11 Drawing Figures

RADIATOR EQUIPPED WITH A CENTRIFUGAL FAN

BACKGROUND OF THE INVENTION

This invention relates to a radiator assembly equipped with a centrifugal fan for dissipating heats from engine coolant.

Axial flow fans are commonly used to improve the circulation of air through the radiators or heat exchangers of vehicles. Such axial flow fans are quite satisfactory where the radiator capacity is rather large as compared to the size of the engine. However, the increasing horsepower used in such vehicles today requires much greater cooling capacity and efficiency. Increasing the size of the radiator is not a practical solution to the problem because of the desire to maintain a reasonably small vehicle profile and because of lack of space available for such increased radiators.

The use of centrifugal fans proposed by U.S. Pat. No. 3,921,603 to Bentz et al is one approach to solving the problem by increasing air flow through radiators. In this patent, however, since the centrifugal fan is radially covered by radiators only three sides with bottom being not covered, part of air flow is apparently wasted.

On the other hand, the use of cylindrical or annular radiators has been increased recently especially for large vehicles having huge horsepower engines mounted thereof because such radiators have relatively short heights compared with their large heat dissipating areas.

One of such prior art devices is disclosed in U.S. Pat. No. 4,062,401 to Rudny et al. In this patent, however, since a propeller type fan is employed for producing air flow, air flow rate is generally not large enough to meet large heat dissipating area of the radiator for a larger vehicle. Besides, engine coolant is introduced into one of the two tanks and discharged from the other tank to the engine after heat in the coolant has been dissipated while passing through a plurality of tubes interconnecting the two tanks. Therefore, pipe arrangement from one of the tanks located remotely from the engine becomes extended and overall piping becomes complicated.

SUMMARY OF THE INVENTION

It is therefore an object of the present invention to provide a radiator equipped with a centrifugal fan which overcomes the above discussed problems of the prior art.

Another object of the present invention is to provide an improved arrangement of fan and radiator that is more compact and efficient than heretofore known systems.

A further object of the present invention is to provide a radiator equipped with a centrifugal fan which can enhance cooling efficiency without increasing rotating speed of the centrifugal fan.

A still further object of the present invention is to provide an improved arrangement of fan and radiator which can be installed in a limited space available and provide an increased air flow through the radiator without increasing the size of the fan.

Still another object of the present invention is to provide a radiator equipped with a centrifugal fan wherein piping arrangements between the engine and the radiator are simplified.

In accordance with an aspect of the present invention, there is provided a cooling arrangement for vehicle engines, comprising: a centrifugal fan mounted on a vehicle for rotation about an axis substantially parallel to the longitudinal axis of said vehicle; and a radiator assembly mounted on said vehicle around the periphery of said fan, said radiator assembly comprising a first tank arranged at one end of said fan, said first tank having an annular inner face and a substantially rectangular outer face and having further formed therein a partition wall separating thereof into a first and a second chamber, said first chamber being connected to an inlet pipe for engine coolant and said second chamber being connected to an outlet pipe for engine coolant; a second tank arranged at the other end of said fan, said second tank having an annular inner face and a substantially rectangular outer face; and a plurality of tubes interconnecting said first and second tanks, each of said tubes having a plurality of fins formed thereon.

In order to improve cooling efficiency of the radiator, axial length of the centrifugal fan is made longer than that of tubes interconnecting the two tanks.

Preferably the centrifugal fan is of both-end suction type for increasing air flow rate without increasing the size of the fan.

The above and other objects, features and advantages of the present invention will be readily apparent from the following description taken in conjunction with the accompanying drawings.

DESCRIPTION OF THE PREFERRED EMBODIMENTS

Figure 1:
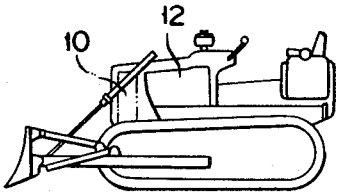
FIG. 1 is a schematic side elevational view of a bulldozer incorporating a radiator of the present invention.
Figure 2:
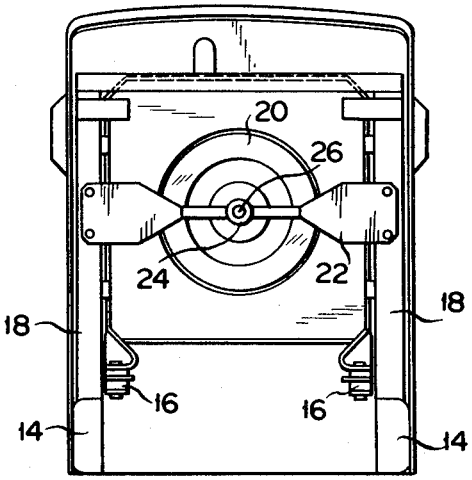
FIG. 2 is a front elevational view of a radiator mounting on a bulldozer according to the present invention.
Figure 3:
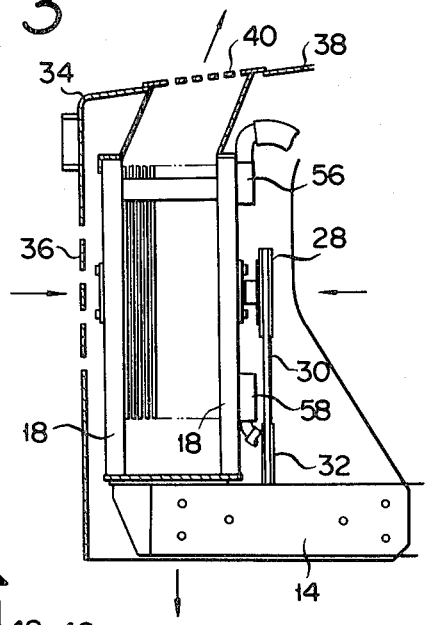
FIG. 3 is a side elevational view of the embodiment of FIG. 2 with a bonnet structure being in cross-section.

The present invention will now be described in detail with reference to the accompanying drawings. Referring first to FIGS. 1 to 3, a radiator assembly generally designated by the reference numeral 10 is mounted in front of an engine compartment 12 of a vehicle such as a bulldozer as illustrated.

Mounted on a main frame 14 of the bulldozer through resilient mounting members 16 is a radiator mounting frame 18 in which the radiator assembly 10 is accommodated mounted thereto. A centrifugal fan 20 is rotatably mounted within a chamber defined by the radiator assembly 10 for rotation about an axis generally extending along the same direction as the longitudinal axis of the vehicle. A pair of transverse cross braces, one of which is shown at 22, are secured to the mounting frame 18 adjacent the end of the fan 20 to provide mounting support for the fan. Each cross brace 22 is provided with a suitable bearing assembly 24 secured thereto for rotatably mounting a shaft 26 of the fan 20. A suitable pulley 28 is secured to the rearward end of the shaft 26 and is drivingly connected by suitable means such as a V-belt 30 to a power take-off pulley 32 which in turn is drivingly connected to an engine (not shown).

Air flow around the radiator assembly 10 is indicated by arrows in FIG. 3. That is, air is introduced into the fan 20 from both axial end thereof since according to a preferred embodiment of the invention the centrifugal fan 20 is the both-end suction type as will be later explained and is discharged through the radiator 10 radially outwardly. Formed in a front panel 34 is a front grille 36 and mounted on the front panel 34 and a top panel 38 is a top or upper grille 40.

Figure 4:
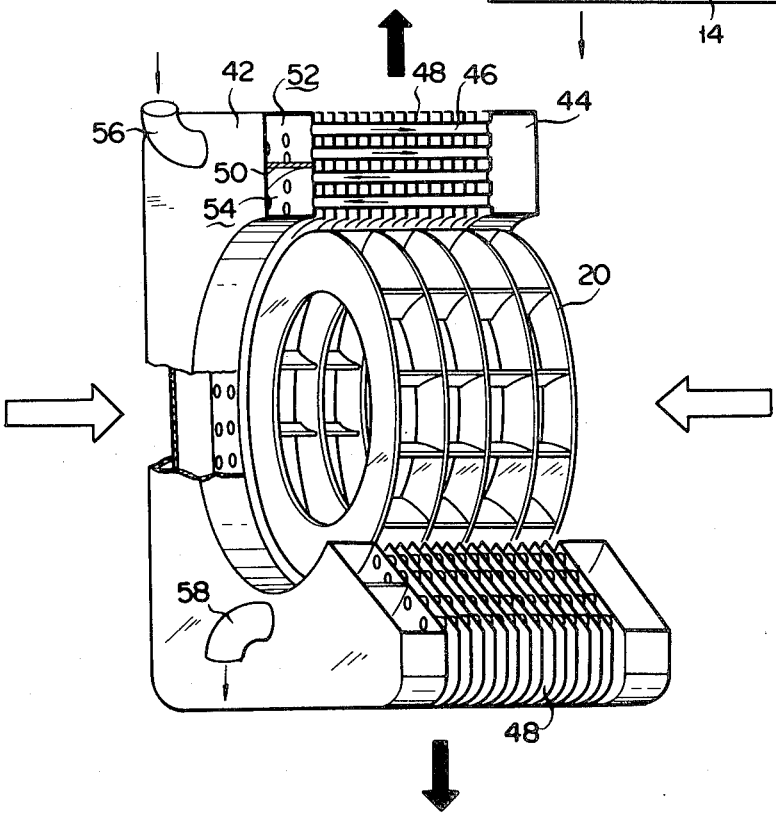
FIG. 4 is a perspective view of a radiator and fan arrangement according to the present invention with the radiator assembly being cut away.

Referring now to FIG. 4 showing a perspective view of a radiator and centrifugal fan arrangement with the radiator assembly 10 being partly cut-away, the radiator assembly 10 comprises a pair of tanks 42 and 44 arranged spaced apart from each other in the longitudinal direction of the vehicle and a plurality of tubes 46 interconnecting the tanks 42 and 44.

Each tank has an annular inner face and a substantially rectangular outer face with each corner being rounded. A plurality of fins 48 are brazed to the tubes 46 each extending across whole bundle of tubes and being vertically oriented with a spaced apart relationship from one another. This tube and fin combination constitutes radiator cores. All tubes 46 are arranged on circles having the same center with each group of tubes 46 on the same circle being equally spaced from one another. The tank 42 disposed on the one side of the engine (not shown) has an annular partition wall 50 dividing the inside of the tank 42 into an inlet side chamber 52 and an outlet side chamber 54. The inlet side chamber 52 is connected to an inlet pipe 56 and the outlet side chamber 54 is connected to an outlet pipe 58, both pipes being connected to a cooling system of the engine (not shown).

The centrifugal fan 20 is disposed within a chamber defined by the radiator assembly 10. This centrifugal fan 20 is preferably of both-end suction type and upon rotation of the fan 20 air is sucked in from both axial ends of the fan as indicated by white arrows and discharged radially outwardly through radiator cores as indicated by black arrows.

Thus engine coolant discharged from the engine is introduced into the inlet side chamber 52 through the inlet pipe 56 and is transferred through outer-half group of tubes 46 to the tank 44 and then back to the outlet side chamber 54 through inner-half group of tubes 46 and is eventually sent back to the engine through the outlet pipe 58.

When passing through the tubes 46, the heat in the engine coolant is dissipated by the air flow from the centrifugal fan 20.

Since outer configurations of the tanks 42 and 44 are made substantially rectangular, tubes can be connected even at portions adjacent to four corners of the tanks 42 and 44. Therefore as compared with radiator assemblies having tanks with annular or cylindrical outer face, more tubes can be connected between the tanks 42 and 44 in the present invention and both tank configuration may occupy substantially same space for installation both laterally and vertically.

Figure 5:
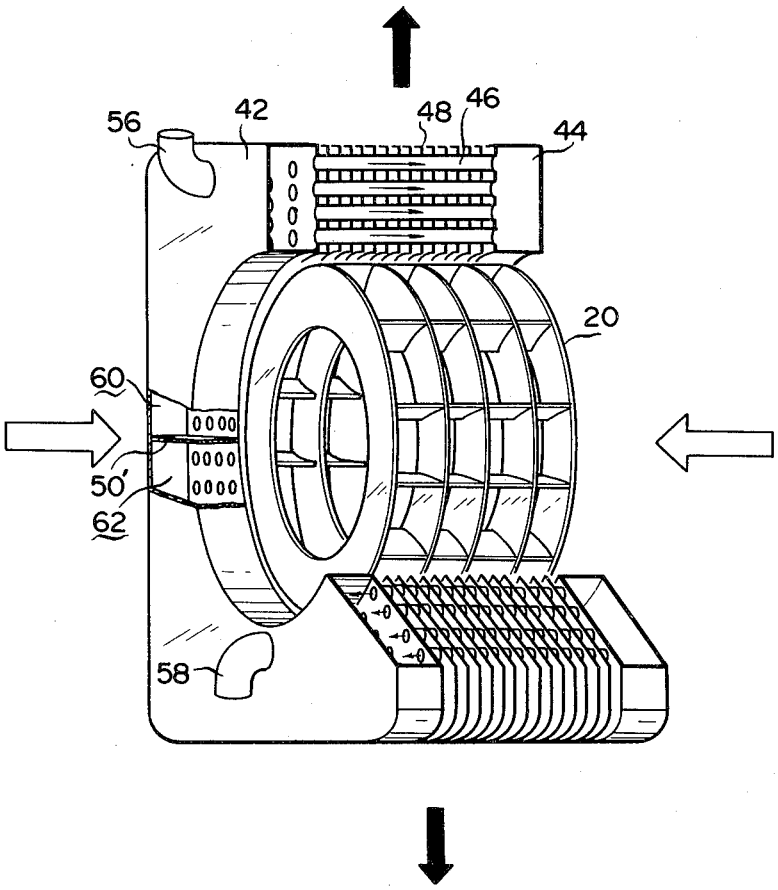
FIG. 5 is similar to FIG. 4 but showing another embodiment of the present invention.

FIG. 5 shows another preferred embodiment of the invention in which a partition wall 50' is laterally provided at vertically intermediate position of the tank 42 to divide the same into an upper chamber 60 and a lower chamber 62. The upper chamber 60 has connected thereto the inlet pipe 56 and the lower chamber 62 has connected thereto the outlet pipe 58. All the other constructions of this embodiment are the same as those of the first mentioned embodiment.

Figure 6:
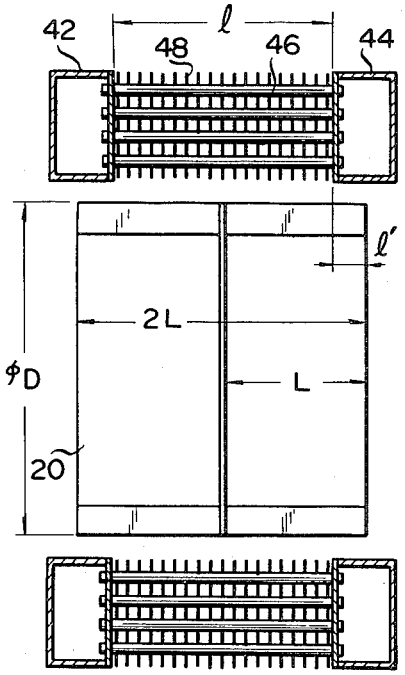
FIG. 6 is a schematic cross-sectional view of a radiator assembly showing how the axial length of a centrifugal fan employed therein extends beyond the length of tubes connecting both tanks.

Referring now to FIG. 6, the axial length of the centrifugal fan 20 is extended beyond the length of the tubes 46.

Figure 7:
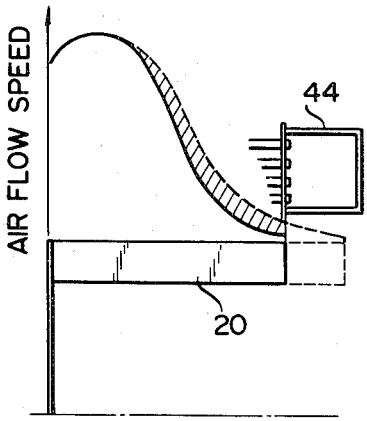
FIG. 7 is a view showing schematically how the air flow speed at the fan's outlet is distributed relative to axial positions of the fan with axially intermediate position of the fan being taken as the origin for abscissa.

The reasons why cooling efficiency of the radiator assembly can be improved by taking the above design are explained hereinbelow. Referring to FIG. 7 showing schematically how the air flow speed at the fan's outlet is distributed relative to axial positions of the fan, it has been experimentally confirmed that air flow speed at the outlet of the fan having the above design is increased by shaded area shown compared with a radiator assembly using the same type of centrifugal fan but having axial length substantially equals to that of tubes 46. As the air flow speed increases, cooling efficiency of the radiator increases as well.

Figure 9:
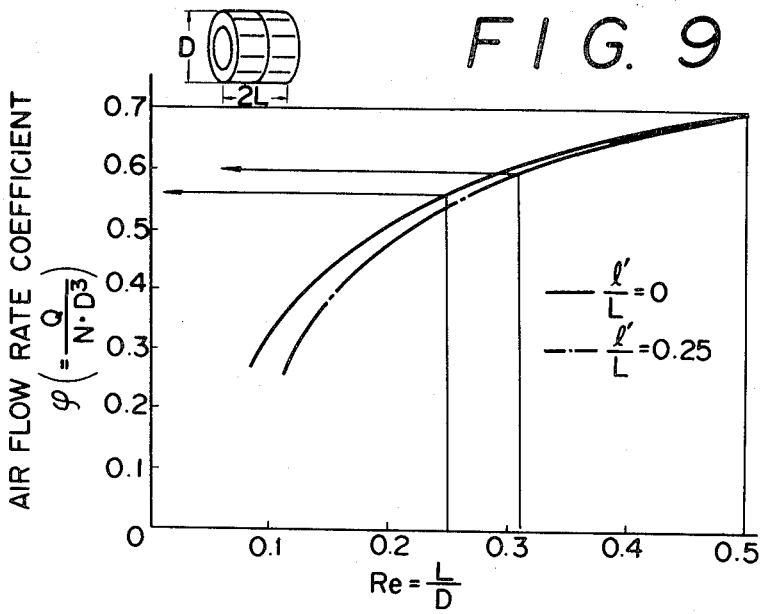
FIG. 9 is a diagram showing a relationship between the air flow rate coefficient and the ratio (Re) of half the axial length of the centrifugal fan to the diameter thereof.

FIG. 9 shows a relationship between the air flow rate coefficient $\phi$ and the ratio Re of half the axial length of the centrifugal fan to the outer diameter thereof: where $\phi = Q/(N \cdot D^3)$; Q is air flow rate ($m^3$/min); N is number of rotations of the fan per minute; $Re = L/D$; L is half of axial length of the fan; D is outer diameter thereof; l is length of the tube; and l' is overhang length of the fan with respect to the tubes.

Consider the situation where $Re = 0.25$. If the length of the fan 20 is made same as that of the tubes 46 ($2L = l$), the air flow rate coefficient becomes 0.56.

On the other hand, if the axial length of the fan 20 is extended to such an extent that $l'/L$ becomes 0.25, the air flow rate coefficient becomes 0.6.

When we divide 0.60 by 0.56, we obtain 1.075. Accordingly, it is observed that the air flow rate of the overhang design is increased by 7.5% over the one having no overhang. This means cooling efficiency of the overhang design improves over the one having no overhang.

A required horsepower to increase the air flow rate is analized and compared hereinbelow. When it is intended to increase the air flow rate by 7.5% by increasing the number of rotations of the fan, consumed horsepower of the fan increases by about 24%. To be more specific, there exist relationships $Q \propto N$ and $PS \propto N^3$: where PS is consumed horsepower. Therefore, we obtain a relationship $PS \propto Q^3$. When we substitute 1.075 for Q, we obtain $PS = 1.075^3 = 1.2423$. This means 24.23% increase of horsepower is necessary to increase the air flow rate by 7.5%.

On the other hand, increasing the air flow rate by means of overhang design will be analized hereinbelow.

Figure 8:
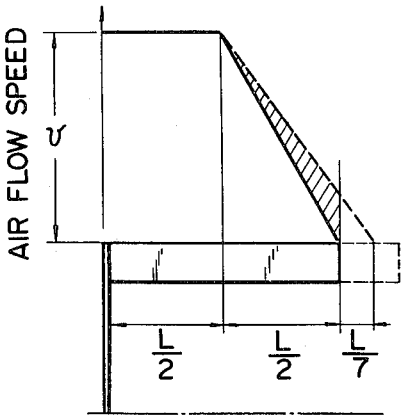
FIG. 8 is an approximated diagram of FIG. 7 for simplification.

FIG. 7 can be approximated to FIG. 8 for simplification. Since $PS \propto Q^3 \propto v^3$, a consumed horsepower $PS_0$ in the case of no overhang design, i.e. $l'/L=0$, will be given as below.

$$PS_0 \alpha \int_0^L v^3 dx = \tfrac{1}{2} L v^3 + \int_0^{L/2} \left( -\frac{2v}{L} x + v \right)^3 dx = \tfrac{5}{8} L v^3$$

In the case of overhang design, i.e. $l'/L=0.25$:

$$PS'_{0.25} \alpha \int_0^{8/7L} v^3 dx = \tfrac{1}{2} L v^3 + \int_0^{9/14L} \left( -\frac{14v}{9L} x + v \right)^3 dx = \frac{37}{56} L v^3$$

Therefore, a required increase of consumed horsepower will be given below.

$$\frac{PS'_{0.25}}{PS_0} = \frac{37/56}{5/8} = 1.057$$

This means a mere increase of 5.7% of consumed horsepower will result in 7.5% increase of air flow rate if an overhang design is employed.

According to a preferred embodiment of the invention, a both-end suction type of centrifugal fan is employed.

The superiority of a both-end suction type over a one-end suction type will be explained below.

If we assume $Re=L/D=0.5$ for the one-end suction type centrifugal fan, then Re for the both-end suction type having the same diameter and half the length will be 0.25. Referring again to FIG. 9, air flow rate coefficient of the one-end suction fan will be 0.7 and that of the both-end suction fan will be $0.56 \times 2 = 1.12$. Therefore, air flow rate of the both-end suction fan may be 60% larger than that of the one-end suction fan. It is generally believed that heat dissipation will be in proportion to the air flow rate to seven-tenths (7/10) power, so the amount of dissipated heat employing the both-end suction fan will be 40% larger than that employing the one-end suction fan.

Figure 10:
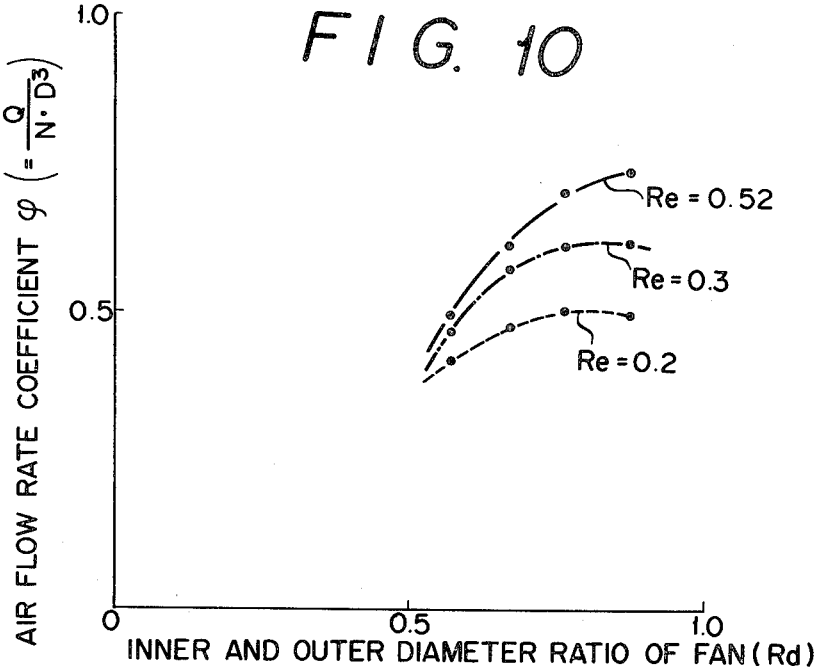
FIG. 10 is a diagram showing a relationship between the air flow rate coefficient and the ratio (Rd) of the inner diameter of the centrifugal fan to the outer diameter thereof.

Referring to FIG. 10 showing a relationship between the inner and outer diameter ratio Rd of a centrifugal fan and air flow rate coefficient $\phi$ by changing L/D wherein L is half the axial length of a centrifugal fan and D is the diameter thereof.

FIG. 10 shows that air flow rate coefficient remains large when Rd is in the range of 0.7 to 0.9.

Figure 11:
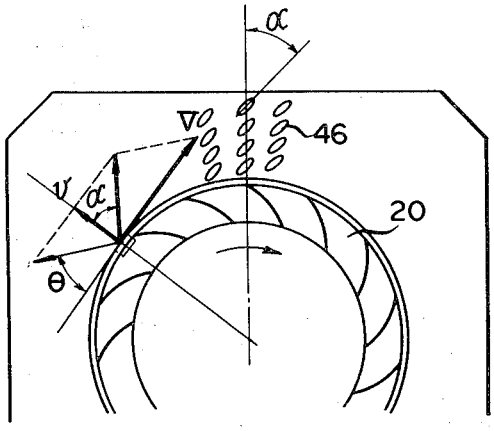
FIG. 11 is a schematic explanational view of one of the preferred arrangements of radiator tubes relative to the fan.

Although it is appropriate for each tube 46 having a circular shape in cross-section in the practice of the invention, each tube having an elliptical cross-section may be more efficient because it reduces air flow resistance. Therefore in a preferred embodiment as shown in FIG. 11, tubes 46 have elliptical cross-section and arranged to be inclined forwardly in the direction of fan rotation (as indicated by an arrow) with an angle $\alpha$ relative to a normal line passing through the center of the centrifugal fan 20.

The angle of air flow being expelled from the fan 20 will be determined by the blade angle $\theta$ at the periphery of the fan, rotational speed of the fan and air flow rate and the direction thereof is always inclined toward the direction of fan rotation. When tubes having elliptical cross-section are arranged in this way, air flow resistance caused by tubes may be significantly reduced. As a result, cooling efficiency can be improved without increasing the size of the radiator assembly.

A pertinent angle $\alpha$ will be obtained by the following equations.

$$\alpha = \tan^{-1}\left( \frac{v}{V - \frac{v}{\tan\theta}} \right)$$

$$v = Q/\pi Dl$$

$$V = \pi DN$$

where:

Q is air flow rate ($m^3$/min);

D is diameter of the fan (m);

l is axial length of each fan (m);

N is number of rotations of the fan (rpm);

$\theta$ is blade angle at the periphery of the fan (degree);

v is speed of air flow in the radial direction (m/min);

V is rotational speed of the fan at the periphery thereof (m/min); and $\alpha$ is air flow angle being discharged from the fan with respect to the normal line (degree).

If we assume D=0.28 m, l=0.16 m, $\theta=30°$, N=2000 rpm and Q=60 $m^3$/min, we obtain $\alpha \approx 67°$ from the above equations.

Therefore if each tube is inclined forwardly in the direction of fan rotation with an angle of 67° relative to the normal line passing through the center of the fan, a minimum air flow resistance may be provided.

Many modifications and variations are possible in light of the above teachings, it is, therefore, to be understood that the invention may be practised otherwise than as specifically described within the scope of the appended claims.

What I claim is:

1. A cooling arrangement for vehicle engines, comprising:

a centrifugal fan mounted on a vehicle for rotation about an axis substantially parallel to the longitudinal axis of said vehicle; and a radiator assembly mounted on said vehicle around the periphery of said fan, said radiator assembly comprising:

a first tank arranged at one end of said fan, said first tank having an annular inner face and a substantially rectangular outer face and having further formed therein a partition wall separating said first tank into a first and a second chamber, said first chamber being connected to an inlet pipe for engine coolant and said second chamber being connected to an outlet pipe for engine coolant;

a second tank arranged at the other end of said fan, said second tank having an annular inner face and a substantially rectangular outer face; and a plurality of tubes interconnecting said first and second tanks, each of said tubes having a plurality of fins formed thereon.

2. A cooling arrangement for vehicle engines are recited in claim 1 wherein axial length of said centrifugal fan is made longer than that of said tubes.

3. A cooling arrangement for vehicle engines as recited in claim 1 or 2 wherein said centrifugal fan is of both-end suction type.

4. A cooling arrangement for vehicle engines as recited in claim 3 wherein the ratio between the inner and outer diameters of said centrifugal fan is made from about 0.7 to about 0.9.

5. A cooling arrangement for vehicle engines as recited in claim 1 or 2 wherein each of said tubes has an elliptical shape in cross-section and is inclined toward the rotating direction of said fan.

6. The cooling arrangement of claim 5 in which the elliptical shape in cross-section is arranged to be inclined forwardly in the direction of the rotation of the fan with an angle relative to a normal line passing through the center of the fan for reducing the air flow resistance.

7. A cooling arrangement for vehicle engines as recited in claim 1 wherein said partition wall is disposed to divide said first tank into said first and second chambers in such a manner that said first chamber is composed of an upper-half of said first tank and said second chamber is composed of a lower-half of said first tank.

8. A cooling arrangement for vehicle engines, comprising:

a centrifugal fan mounted on a vehicle for rotation about an axis substantially parallel to the longitudinal axis of said vehicle; and a radiator assembly mounted on said vehicle around the periphery of said fan, said radiator assembly comprising:

a first tank arranged at one end of said fan, said first tank having an annular inner face and a substantially rectangular outer face and having further formed therein a partition wall separating said first tank into a first and a second chamber in such a manner that said first chamber is radially outwardly located and said second chamber is radially inwardly located;

said first chamber being connected to a first pipe for engine coolant and said second chamber being connected to a second pipe for engine coolant;

a second tank arranged at the other end of said fan, said second tank having an annular inner face and a substantially rectangular outer face; and a plurality of tubes interconnecting said first and second tanks, each of said tubes having a plurality of fins formed thereon.

9. The cooling arrangement of claim 8 in which the first pipe is an inlet pipe and the second pipe is an outlet pipe.

* * * * *